United States Patent [19]

Khorsand

[11] 4,441,421

[45] Apr. 10, 1984

[54] PRINT HAMMER APPARATUS

[76] Inventor: Hossein Khorsand, 33042 Commodore Ct., San Juan Capistrano, Calif. 92675

[21] Appl. No.: 421,236

[22] Filed: Sep. 22, 1982

[51] Int. Cl.[3] ..... B41J 3/00

[52] U.S. Cl. ..... 101/93.04; 101/93.48

[58] Field of Search ..... 101/93.04, 93.48, 93.29, 101/93.33, 93.34

[56] References Cited

U.S. PATENT DOCUMENTS

| | | | |
|---|---|---|---|
| 3,228,325 | 1/1966 | Miller | 101/93.34 |
| 3,742,800 | 7/1973 | Frohrib | 101/93.48X |
| 3,941,051 | 3/1976 | Barrus et al. | 101/93.04 |
| 4,190,847 | 2/1980 | Stenudd | 101/93.48 X |
| 4,224,589 | 9/1980 | Tamulis | 101/93.29 X |
| 4,236,842 | 12/1980 | Dick et al. | 101/93.48 X |
| 4,327,638 | 5/1982 | Wassermann | 101/93.34 X |
| 4,327,639 | 5/1982 | Crystal et al. | 101/93.48 X |
| 4,359,937 | 11/1982 | Helinski | 101/93.04 |

FOREIGN PATENT DOCUMENTS

| | | | |
|---|---|---|---|
| 47883 | 3/1982 | European Pat. Off. | 101/93.04 |
| 56-80486 | 7/1981 | Japan | 101/93.48 |

OTHER PUBLICATIONS

*University Physics,* by Francis Weston Sears et al. Published 1955, pp. 644–645.

IBM Technical Disclosure Bulletin "Print Mechanism" by R. D. Mathews, vol. 19, No. 9, Feb. '77, pp. 3245–3246.

*Primary Examiner*—Edgar S. Burr

*Assistant Examiner*—John A. Weresh

*Attorney, Agent, or Firm*—Paul F. Horton

[57] ABSTRACT

Print hammer apparatus comprising a hammer preferably having a non-magnetic flexure provided with a magnetic hammer head and stylus and held in a normally retracted position by a permanent magnet. A pole piece, for concentrating magnetic flux onto the hammer head, is in magnetic contact with the permanent magnet and defines a slot in which the hammer head is received. The hammer head is separated from the pole piece by a minute air gap. An electromagnet is operable, upon activation, to release the hammer from its retracted position for printing. The unique pole piece and hammer head combination and the use of non-magnetic flexures in specialized forms maximize hammer speed for pre-selected forces at pre-selected retracted distances. Positioning the stylus at the center of percussion of the flexure and alignment of longitudinal axes of hammer head, the pole piece ofthe electromagnet, and the stylus also contribute to superior performance.

10 Claims, 10 Drawing Figures

PRINT HAMMER APPARATUS

BACKGROUND OF THE INVENTION

1. Field of the Invention

This invention relates, in general, to printers of the dot matrix type and particularly to an improved print hammer mechanism.

2. Description of the Prior Art

Dot matrix printers utilizing hammer banks having hammers retracted by a permanent magnet and selectively released by electromagnets so as to impact an ink ribbon against a platen supported print paper by means of an affixed stylus for printing is widely known in the art. Such printers are shown by R. A. Kleist et al in U.S. Pat. No. 4,033,255 and U.S. Pat. Nos. 3,941,051; 4,044,668, and 4,233,894 issued to Barrus et al. While contributing greatly to the art, the speed of operation of such hammer mechanisms is substantially impaired in utilizing magnetic flexure elements to form a portion of the magnetic flux circuitry with a substantial loss of flux density for hammer elements. A magnetic ribbon shield, parallel with and separated from the hammer flexure by an air gap, has been improvised in attempting to correct this problem. Such a system has two air gaps—one between the flexure and electromagnetic pole and a second between ribbon shield and flexure. The second gap becomes large and is a source of high reluctance in conjunction with the long length of flux path. An additional problem affecting printers' speed in the current state of the art is flexure design. Existing flexures are substantially rectangular in shape and are of comparatively low natural frequency. Additional drawbacks common to hammer mechanisms in the art, which have their stylus at the center of percussion, are offset positioning of the longitudinal axes of the stylus and the pole of the electromagnet. Where the center of percussion is not near the point where the hammer strikes against the electromagnetic pole piece, a minute rubbing action between the meeting surfaces results in high wear. It is therefore desirable to increase the flux density of the hammer element by shortening the flux path and by reducing reluctance. It is also desirable to increase the natural frequency of the flexure elements for greater printer speed; to position the stylus at the center of mass of the hammer's head; and to position the stylus at the point where the hammer strikes the pole piece of the electromagnet.

SUMMARY OF THE INVENTION

Improved print hammer apparatus made in accordance with the present invention includes a permanent magnet; hammers preferably having non-magnetic flexures with magnetic, stylus carrying, heads received in and separated by minute air gaps from a pole piece of the permanent magnet; and electromagents operable to cancel the magnetic flux of the permanent magnet when activated to release retracted hammers for printing. A more thorough and complete description of the apparatus may be found in the appended claims.

It is therefore a primary object of the present invention to provide improved print hammer mechanism, low in reluctance, and having a shortened flux path for greater flux density adjacent the hammer heads.

It is also an important object of the present invention to provide improved print hammer mechanisms with flexures having higher natural frequencies than those now found in the art for greater hammer speed.

It is another object of the present invention to provide improved print hammer mechanisms wherein the stylus is located at the center of mass of the hammer head and also where the longitudinal axis of the stylus is in alignment with the longitudinal axis of the pole piece of the electromagnet associated with each hammer.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 2:
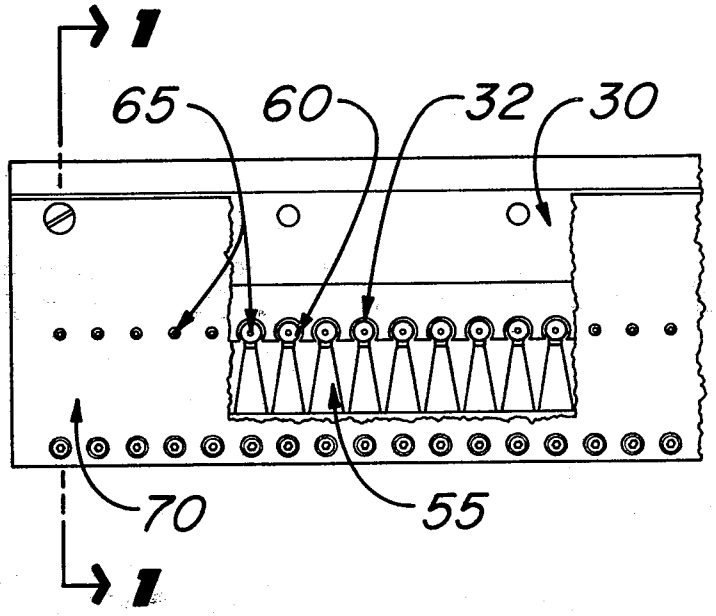
FIG. 2 is a partial front view showing a hammer bank utilizing print hammer mechanisms of the present invention.

The print hammer mechanism of the present invention may be used either singularly or with a hammer bank, a portion of which is shown in FIG. 2. It is contemplated that the greatest demand for the device will be in conjunction with a reciprocating shuttle for use as a dot matrix printer.

Figure 1:
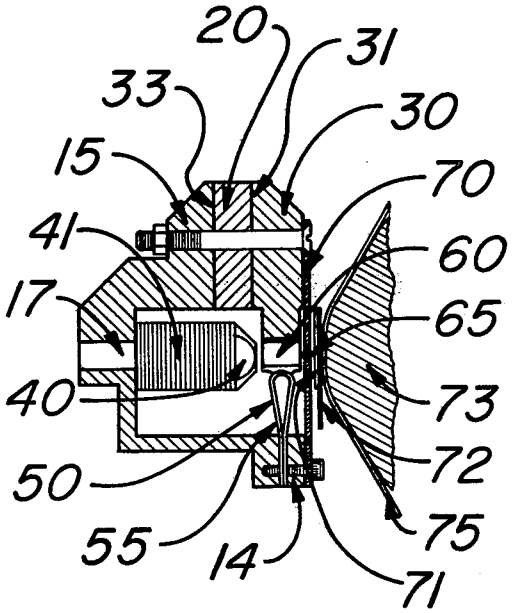
FIG. 1 is a side sectional view of one embodiment of the print hammer mechanism of the present invention.

Referring now to the drawings, and, more particularly, to FIG. 1, an embodiment to be preferred of a print hammer mechanism 10 made according to the present invention is disclosed. Print hammer mechanism 10 includes a permanent magnet 20, a first pole piece 30, a second pole piece 15, an electromagnet 40, and a hammer 50 including flexure 55, magnetic hammer head 60 and stylus 65. Stylus 65 impacts against an ink ribbon 71 to print on paper 75 held in place by paper shield 72, against platen 73 as flexure 55 springs from its normally retracted position. Paper shield and platen are all preferably nonmagnetic.

Permanent magnet 20 provides a magnetic force for retracting hammer heads 60 against the spring resistance of flexure 55. For multiple hammers, as in a hammer bank, the permanent magnet is in the form of an elongated bar serving as a common magnet for all hammers.

First pole piece 30 is a magnetic body of mass extending from one pole of the permanent magnet, identified in the drawing as first pole 31, forwardly and downwardly adjacent one or more hammer heads 60 to focus magnetic flux onto the hammer heads. Where a plurality of hammers are used, the first pole piece 30 may be in an elongated form, as shown in FIG. 2, however it is preferred that each hammer have an individual pole piece that is magnetically isolated from adjacent pole pieces. Pole piece 30 is provided with one or more laterally aligned slots 32 which effectively encompass respective magnetic hammer heads 60. Each hammer head is thereby coupled magnetically to the first pole piece, or pieces, 30 via a relatively constant air gap to provide a flux path from the pole piece through its body to the pole face of a respective electromagnet 40 via a variable air gap. The configuration of slots 32 may vary, it only being essential that the configuration of the slot conform to the configuration of the hammer head to minimize the air gap and to maximize flux as will hereinafter be explained. It is also obvious that a hole may be provided instead of slot 32 and therefore the term "slot" as used herein and in the claims includes use of a hole for receiving the hammer head.

Second pole piece 15 is a structural body of magnetic mass coupling electromagnets 40 to the second pole 33 of permanent magnet 20, preferably by means of a pole rod 17 as shown in FIG. 1. The second pole piece also serves as a structural body to which flexures 55 are secured by means of clamp plates 14, preferably non-magnetic. For hammer banks, the second pole piece is an elongated common piece for securing all of the flexures.

Electromagnets 40, formed by energizing coils 41 disposed about pole rod 17, neutralize the flux of the permanent magnet, when energized. Pole rod 17 of the electromagnet is at a 90° angle from the terminal face of the first pole piece, and the pole face of the electromagnet faces the hammer head.

In that the performance of print hammer mechanisms depend largely upon spring or flexure 55 used, as well as the magnetic circuits, the design of the spring and the material from which it is made are critical in maximizing performance. The function of the flexure is to store potential energy which is converted to kinetic energy as the hammer approaches its neutral position. A fraction of the kinetic energy is used to print a dot on all sheets of a multiple layered paper. The energy is stored in the spring by subjecting it to stress within its elastic limit. The amount of energy stored in the spring is proportional to the magnitude of stress per unit mass. The natural frequency of flexure 55 determines to a large extent the speed of the print hammer. Since the natural frequency is proportional to the square root of the inverse ratio of mass, it is necessary to minimize the mass to increase the frequency, while subjecting the mass to uniform stress within its elastic limit for maximum energy storage. As an example, a simple cantilever spring of constant rectangular cross-section is an inefficient design for satisfying the above criteria. When such a spring is deflected and stressed, its stress would vary from zero near its free end to its maximum at the clamped end, near the surface. Also, the stress would change from a negative to zero and then to a positive value across its thickness. Substantial quantity of the mass elements would have no stress or low stress and they therefore would not contribute to energy storage as intended. It is, therefore, important to the present invention to have a flexure 55 in which the body is substantially subjected to relatively uniform stress throughout its mass and of such design that the flexure will be very stiff in all directions of translation or rotation with respect to the direction which the spring deflects from print position to retracted position and visa versa. The design alternative shown in FIGS. 6 through 10 each show improvement over the simple, constant rectangular cross-section, spring or flexure.

Figure 6:
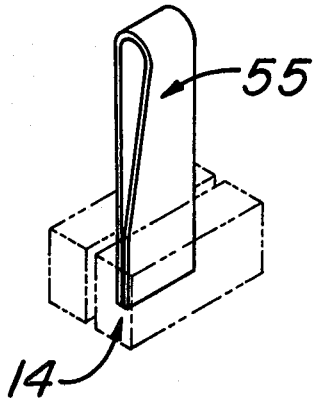
FIG. 6 is a perspective view of a preferred embodiment of a single flexure of the print hammer mechanism of the present invention.

Alternative No. 1, as shown in FIG. 6, is a loop flexure having overlapping fixed ends. This flexure is highly efficient as each leg of the loop is either in compression or tension, thus eliminating the unstressed mass at the neutral axis. Also the loop becomes subjected to stress as the flexure is flexed. The flexure is trapezoidal along its length to further help distribution of the stress. Since the joint at the loop end of flexure 55 and hammer head 60 must be high strength and high temperature weld joint, the flexure must be made from non-magnetic material. Magnetic material, such as hardened ferromagnetic steel would be adversely affected during the welding operation. 17-7 PH stainless steel is highly preferred as a material for the flexures.

Magnetic, hardened steel may be used if the hammer head is not welded to the flexure, but mechanically joined.

Figure 7:
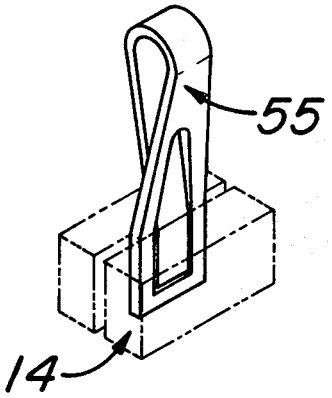
FIG. 7 is a perspective view of another embodiment of the flexure.

Alternative No. 2, as shown in FIG. 7, is a loop flexure 55 having a single plane at fixed ends. The neutral axis of the cross-section of the legs are in a single plane, thus leaving the loop relatively stress free when the flexure is flexed. Since the top part does not carry stress as in the first alternative, this flexure is not as efficient as the first alternative, but has marked improvement characteristics as compared with the conventional flexures, rectangular in cross-section.

Figure 8:
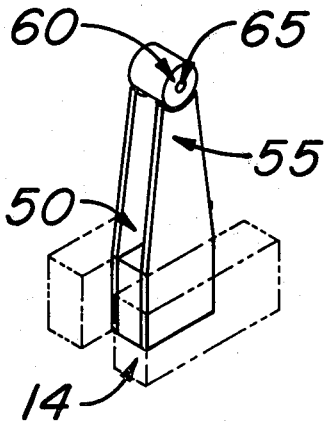
FIG. 8 is a perspective view of another embodiment of a single flexure of the print hammer mechanism of the present invention.

Alternative No. 3, as shown in FIG. 8, is a parallel spring flexure. This flexure is very efficient due to well distributed stress throughout each leg due to the elongated trapezoidal shape of each leg.

Figure 9:
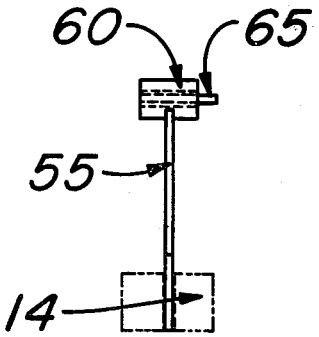
FIG. 9 is a side view of a fourth embodiment of a single flexure of the print hammer mechanism of the present invention.
Figure 10:
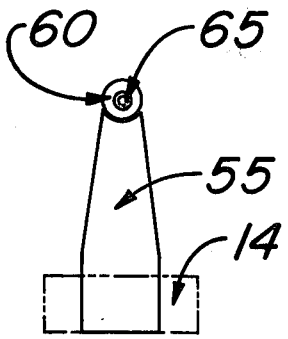
FIG. 10 is a frontal view of the flexure of FIG. 9.

Alternative No. 4, as shown in FIGS. 9 and 10, is a variable cross-section rectangular flexure having a single leg. A variable width, constant depth rectangular cross-section spring is an improvement over a constant rectangular cross-section spring, since the stress in the frame is more evenly distributed than in the latter, when they are deflected. This type of flexure, although an improvement over conventional flexures is not as efficient as the previous alternatives and is not as resistant to twist as the previous alternatives. Construction must be of non-magnetic material where hammer head 60 is welded to flexure 55, rather than affixed mechanically. It is to be noted that in all alternatives stylus 65 is affixed to hammer head 60 with the longitudinal axis of each stylus in substantial alignment with the longitudinal axis of each electromagnet 40. It is also to be understood that the term "stylus" as used herein and in the appended claims includes impact elements whether sharp, blunt or spherical.

Figure 3:
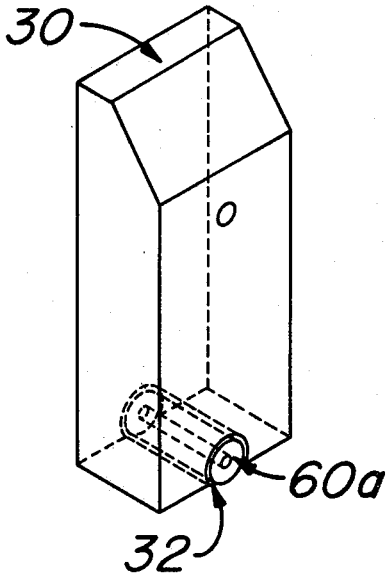
FIG. 3 is a perspective view of one embodiment of the pole piece with slot and hammer head contained within the slot of the hammer mechanism of the present invention.
Figure 4:
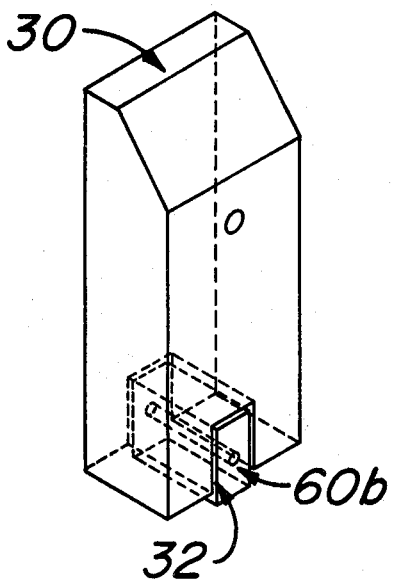
FIG. 4 is a perspective view of a second embodiment of pole piece with slot and hammer head contained within the slot of the hammer mechanism of the present invention.
Figure 5:
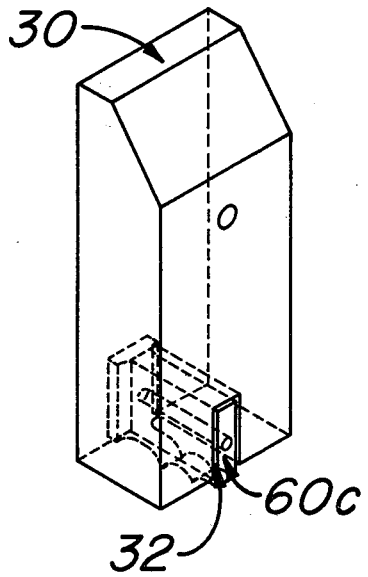
FIG. 5 is a perspective view of a third embodiment of pole piece with slot and hammer head contained with the slot of the hammer mechanism of the present invention.

As before stated, print hammer mechanisms depend largely upon the springs or flexures as well as the magnetic circuits for optimal performance. The function of such magnetic circuits is to provide retracting force to overcome the spring force of the flexure 55 and to neutralize the retracting force instantaneously to fly stylus 65 forward for print action. The spring energy required is dependent on the amount of print energy required and also depends upon how much of the energy stored in the spring is available as print energy at impact. If the point of impact corresponds to the center of mass of the hammer's head, then all or substantial amounts, of the stored energy will be available as print energy. The present invention places the center of the hammer's head at the impact point, therefore, all, or substantial amounts of, the stored energy in the spring is available as print energy at the point of impact. Since the print energy is a fixed known value, the spring energy is also a known and fixed value. The spring energy is created by the energy of permanent magnet 20 and is a function of the permanent magnet's field intensity. However the field intensity of permanent magnet 20 varies along the magnetic circuit depending upon the reluctance of the circuit. The field intensity in the flux path of magnetic hammer head 60 determines the energy which could be stored in the spring. Storing energy, at its maximum limit, in the spring is a relatively easy task. Placing a high intensity field magnet in the circuits would saturate the hammer flux path thus storing the maximum possible amount of energy in flexure 55. The problem is to generate an opposite field of the same intensity by electromagnets 40 to counteract the field of permanent magnet 20 at hammer head 60. This is a problem, as the electromagnet field intensity depends upon the number of coil windings 41 and the current in the coil. The number of windings are limited by the relatively tight space between adjacent coils in a hammer bank. The amount of current which can be applied to the coil is limited by the capacity of the structure to dissipate the heat. When the variable air gap between the electromagnet pole face and the hammer head is small or zero, the number of flux lines reaching the hammer head by the opposite fields created by the permanent magnet and the electromagnet may be the same, although the field intensity of the electromagnet 40 could be much lower than the field intensity of the permanent magnet 20. This is due to relatively high reluctance of the circuit for the flux lines from permanent magnet 20 to the hammer head as compared to the reluctance of the circuit for the flux lines from the electromagnet pole face to the hammer head when hammer head is contacting the electromagnet pole face. As the variable gap between the pole face of electromagnet 40 and hammer head 60 becomes wider, the reluctance for the flux lines of both magnets approaches the same value, thus necessitating relatively equal field intensity generation by both magnets. Otherwise, the flight of the hammer head, with affixed stylus, approaching print position will be slowed down near the print position due to the high flux field of the permanent magnet compared to the neutralizing field of the electromagnet. Thus it is evident at large gaps of the variable air gap the field intensity created by the electromagnet sets the limit of the field intensity which the permanent magnet should generate. As the air gap varies from zero to its maximum, at the print position, the value of reluctance for the flux lines from permanent magnet 20 to hammer head 60 decreases compared to the reluctance for the neutralizing flux lines from electromagnet 40 to the hammer head. At zero gap, the relative reluctance for the flux lines from the permanent magnet to the hammer head is at its maximum value. At small gaps of the variable air gap, the hammer is substantially retracted and relatively small additional reductions of air gap result in relatively large additional amounts of energy storage in the spring. It is, therefore, apparent that reducing the relative reluctance of the flux path for the flux lines reaching the hammer head from the permanent magnet at zero gap of the variable air gap would result in higher flux density at the hammer pole and higher energy storage in the spring without further tasking of the electromagnet. Stated another way, the field intensity required from permanent magnet 20 is dictated by the maximum field intensity electromagnet 40 could generate without overheating. Any reduction of reluctance in the circuit will therefore aid in increasing the average retractive force without demanding a higher neutralizing field from the electromagnet. The present invention reduces the reluctance by placing permanent magnet 20 as close as physically possible to magnetic hammer head 60 of hammer 50 in such a manner not to cause excessive amount of flux bypassing the hammer flux path through air; by minimizing the reluctance from the terminal area of the permanent magnet first pole piece 30 to hammer head 60 by making the adjacent surfaces as large as practically possible and the air gap between them as small as practically possible; and by reducing the length of the hammer flux path to its minimum while allowing adequate cross-sectional area for the flux path, thus utilizing the body of the hammer head as an efficient conduit for the magnetic flux, as shown by hammer heads 60*a*, 60*b*, and 60*c* received within slots 32 in FIGS. 3, 4, and 5 respectively.

To reduce wear of hammer head 60 and the face of pole 17 of electromagnet 40 as they impact, the longitudinal axes of hammer head and electromagnet are placed in substantial alignment.

Having thus described in detail a preferred selection of embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. Print hammer apparatus comprising:

a permanent magnet;

a first pole piece and a second pole piece in magnetic contact with opposing poles of said permanent magnet, one and only one of said pole pieces defining a slot for receiving a hammer head and effectively encompassing the hammer head for focusing magnetic flux onto said hammer head;

a hammer including a flexible mounting element having a fixed end and a free end, the free end provided with a magnetic hammer head and a stylus, said hammer head receivable within said slot of said pole piece, said slot consisting of a recess in said pole piece having the same general cross sectional shape as the cross sectional shape of said hammer head, and of a size so as to provide a minute air gap between said slot and said hammer head, each hammer normally being held in a retracted flexed position; and an electromagnet, which when activated is operable to provide a magnetic flux of sufficient magnitude to cancel the magnetic flux of said permanent magnet to release the hammer head from its retracted position for printing.

2. The apparatus as described in claim 1 wherein the longitudinal axis of said hammer head is in substantial alignment with the longitudinal axis of the pole piece of said electromagnet and the longitudinal axis of said stylus.

3. The apparatus as described in claim 1 wherein said flexible mounting element is constructed of non-magnetic material.

4. The apparatus as described in claim 3 wherein said flexible mounting element is constructed of stainless steel.

5. Apparatus as described in claim 1 wherein said flexible mounting elements of each hammer are in the form of a loop being bent back upon itself to define a pair of leg portions.

6. Apparatus as described in claim 5 wherein said flexible mounting element is trapezoidal in form along its length.

7. Apparatus as described in claim 1 wherein said flexible mounting element of each hammer is in the form of a loop defining a first slotted leg and a second leg received by and in a single plane with said first leg.

8. Apparatus as described in claim 7 wherein said first leg is trapezoidal in form along its length.

9. Apparatus as described in claim 1 wherein said flexible mounting element of each hammer comprises at least two legs, parallel spaced, and trapezoidal in form along their lengths.

10. Apparatus as described in claim 1 wherein said flexible mounting element of each hammer comprises a single leg, variable in width and having a constant depth.

* * * * *